US009784043B2

(12) United States Patent
Igleheart, IV et al.

(10) Patent No.: US 9,784,043 B2
(45) Date of Patent: Oct. 10, 2017

(54) RELEASABLE CONNECTION FOR COILED TUBING DRILLING APPARATUS

(71) Applicant: Schlumberger Technology Corporation, Sugar Land, TX (US)

(72) Inventors: Austin Smith Igleheart, IV, Atlanta, GA (US); Lawrence James Leising, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 338 days.

(21) Appl. No.: 14/419,890

(22) PCT Filed: Aug. 8, 2013

(86) PCT No.: PCT/US2013/054095

§ 371 (c)(1),
(2) Date: Feb. 5, 2015

(87) PCT Pub. No.: WO2014/025975

PCT Pub. Date: Feb. 13, 2014

(65) Prior Publication Data

US 2015/0197994 A1 Jul. 16, 2015

Related U.S. Application Data

(60) Provisional application No. 61/680,887, filed on Aug. 8, 2012.

(51) Int. Cl.
*E21B 17/06* (2006.01)
*E21B 33/12* (2006.01)
(Continued)

(52) U.S. Cl.
CPC ..... *E21B 17/06* (2013.01); *E21B 33/12* (2013.01); *E21B 34/16* (2013.01); *E21B 47/06* (2013.01); *E21B 2034/005* (2013.01)

(58) Field of Classification Search
CPC ..... E21B 17/02; E21B 17/04; E21B 17/06; E21B 17/076; E21B 19/16; E21B 19/165
(Continued)

(56) References Cited

U.S. PATENT DOCUMENTS 4,033,414 A 7/1977 Stroble
4,750,560 A 6/1988 Gazda
(Continued)

FOREIGN PATENT DOCUMENTS

WO 2014025975 A1 2/2014

OTHER PUBLICATIONS

International Search Report for International Application No. PCT/US2013/054095 dated Nov. 7, 2013.

*Primary Examiner* — Kenneth L Thompson

(57) ABSTRACT

A releasable connection for coiled tubing drilling apparatus is presented wherein the connection has an outer body configured with an inner volume, a mandrel located at least partially within the outer body and in the inner volume, a plug located with the outer body and a structural weakpoint apparatus, wherein the structural weakpoint apparatus is configured to structurally fail at a predetermined tensile load placed upon the releasable connection apparatus, wherein the structural weakpoint apparatus is configured at a lower end of the mandrel.

16 Claims, 11 Drawing Sheets

(51) Int. Cl.
*E21B 34/16* (2006.01)
*E21B 47/06* (2012.01)
*E21B 34/00* (2006.01)

(58) Field of Classification Search
USPC ..... 166/66.6, 66.5, 66, 65.1, 250.01, 117, 166/242.6; 175/257, 309
See application file for complete search history.

(56) References Cited

U.S. PATENT DOCUMENTS

| | | | | |
|---|---|---|---|---|
| 5,323,853 | A | 6/1994 | Leismer et al. | |
| 5,660,241 | A | 8/1997 | Leising et al. | |
| 5,787,982 | A | 8/1998 | Bakke | |
| 5,810,088 | A | 9/1998 | Lamirand et al. | |
| 5,857,710 | A | 1/1999 | Leising et al. | |
| 5,947,198 | A | 9/1999 | McKee et al. | |
| 5,984,006 | A | 11/1999 | Read et al. | |
| 6,131,953 | A | 10/2000 | Connell et al. | |
| 6,349,767 | B2 | 2/2002 | Gissler | |
| 6,626,244 | B2 * | 9/2003 | Powers | E21B 17/003 166/242.7 |
| 6,712,146 | B2 | 3/2004 | Estep et al. | |
| 7,100,696 | B2 * | 9/2006 | Marshall | E21B 31/00 166/242.6 |
| 7,152,674 | B2 | 12/2006 | Bowles | |
| 7,249,633 | B2 | 7/2007 | Ravensbergen et al. | |
| 7,992,638 | B2 | 8/2011 | Benton et al. | |
| 8,141,634 | B2 * | 3/2012 | Fisher | E21B 17/023 166/242.6 |
| 2007/0256867 | A1 | 11/2007 | DeGeare et al. | |
| 2011/0024133 | A1 | 2/2011 | Sach | |

* cited by examiner

FIG.2
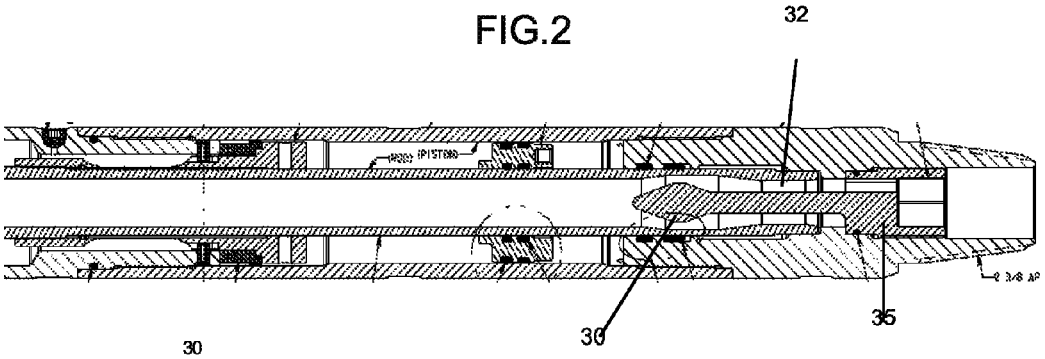
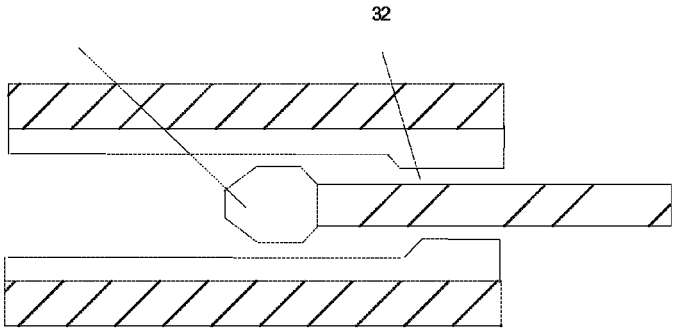
RUNNING CONDITION
FIG. 3
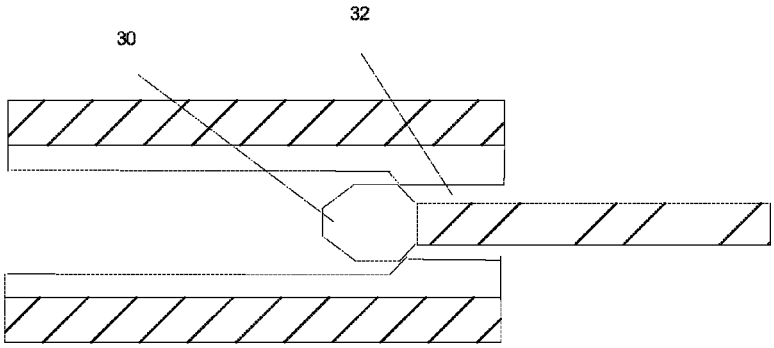
ACTUATED CONDITION
FIG. 4

RUNNING CONDITION

ACTUATED CONDITION

RUNNING CONDITION

ACTUATED CONDITION

RUNNING CONDITION

ACTUATED CONDITION

RUNNING CONDITION

ACTUATED CONDITION

RUNNING CONDITION

ACTUATED CONDITION

RUNNING CONDITION

ACTUATED CONDITION

RUNNING CONDITION

ACTUATED CONDITION

RELEASABLE CONNECTION FOR COILED TUBING DRILLING APPARATUS

TECHNICAL FIELD

Aspects of the present disclosure relate to coiled tubing drilling. More specifically, aspects described herein relate to providing an arrangement and method for indicating actuation of an incremental disconnect device.

BACKGROUND INFORMATION

This section is intended to introduce the reader to various aspects of art that may be related to various aspects of the subject matter described and/or claimed below. This discussion is believed to be helpful in providing the reader with background information to facilitate a better understanding of the various aspects of the present disclosure. Accordingly, it should be understood that these statements are to be read in this light, not as admissions of prior art.

Coiled tubing drilling provides many significant advantages for drillers seeking to penetrate geotechnical stratum. Conventional coiled tubing drilling utilizes a flexible tubing that is wound around a spindle. At the bottom end of the coiled tubing, a drill bit may rotate, grinding the formation contacted into fragments. The fragments are removed from the resulting borehole by flushing the fragments from the bottom of the borehole with a fluid up the borehole to the surface.

To reach differing areas inside the geotechnical stratums, it is sometimes necessary to drill at orientations other than from the vertical. Coiled tubing may use a housing that allows the drill bit to be at an angle compared to the remainder of the coiled tubing apparatus. The angled or "bent" housing allows drillers to drill the borehole at a deviated angle compared to the vertical.

While drilling deviated wellbores has many advantages, some significant drawbacks are present. Deviated wellbores can cause binding on the coiled tubing apparatus. The binding can get worse with increasing wellbore deviation as the coiled tubing increasingly contacts the sides of the wellbore.

Binding may increase to such a point that the coiled tubing becomes stuck in the wellbore. When the coiled tubing gets stuck, retrieval of the apparatus is necessary but can sometimes be difficult or even impossible. The drill bit and associated downhole hardware may be disconnected from the remainder of the coiled tubing so the coiled tubing can be quickly and safely recovered. To recover the bottom section of the coiled tubing drilling apparatus, a separate tool may be used to latch to the stuck bottom section. The specialized tool allows operators to exert a larger tensile capacity on the stuck components, breaking the frictional forces on the stuck components.

Many downhole applications may utilize differing disconnects. These disconnects can use a tensile, electrical or hydraulic arrangement or a combination of these disconnect technologies. Conventional technologies, however, do not provide a reliable and economical disconnect capability.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one embodiment, a releasable connection apparatus for coiled tubing includes an outer body configured with an inner volume, a mandrel located at least partially within the outer body and in the inner volume, the mandrel configured to be actuated by an operator from a first non-actuated position to a second actuated position, a plug located with the outer body, the plug movable between a first position to a second position, the plug actuated by the mandrel, wherein when the plug is in the first position, a clear flowpath is maintained for materials flowing past the mandrel and wherein when the plug is in the second position, the flowpath is at least partially blocked, wherein in the second position an increase in fluid pressure occurs signaling actuation of the releasable connection, and a structural weakpoint apparatus. The structural weakpoint apparatus is configured to structurally fail at a predetermined tensile load placed upon the releasable connection apparatus, wherein the structural weakpoint apparatus is configured at a lower end of the mandrel.

In accordance with another embodiment, a releasable connection apparatus includes an outer body configured with an inner volume, a mandrel located at least partially within the outer body and in the inner volume, the mandrel configured to be actuated from a first non-actuated position to a second actuated position, a solenoid connected to the mandrel, wherein the solenoid is configured to actuate the mandrel from the first non-actuated position to the second actuated position, a restriction arrangement located within the outer body, the restriction arrangement movable between a first position to a second position, wherein when the restriction arrangement is in the first position, a clear flowpath is maintained for materials flowing within the outer body and wherein when the restriction arrangement is in the second position, the flowpath is at least partially blocked, and a structural weakpoint apparatus, wherein the structural weakpoint apparatus is configured to structurally fail at a predetermined tensile load placed upon the releasable connection apparatus.

In yet another embodiment, a method includes a method to indicate actuation of a coiled tubing releasable connection apparatus. The method includes providing a coiled tubing arrangement in a downhole configuration, wherein the coiled tubing arrangement is provided with at least one coiled tubing releasable connection apparatus, conducting a tensile pull on the coiled tubing arrangement wherein the tensile pull actuates the at least one coiled tubing releasable connection apparatus, impeding a flow within the coiled tubing arrangement such that a pressure increase is created in the flow after the actuation of the at least one coiled tubing releasable connection apparatus, and sensing the pressure increase from the impeded flow.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 2 is a partial side elevation view of the releasable connection apparatus in accordance with the embodiment illustrated in FIG. 1.

FIG. 3 is a side elevation view of a plug of the releasable connection apparatus in a running condition.

FIG. 4 is a side elevation view of the plug of the releasable connection apparatus in an actuated condition.

DETAILED DESCRIPTION

One or more specific embodiments of the present disclosure are described below. These embodiments are only examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features.

Figure 1:
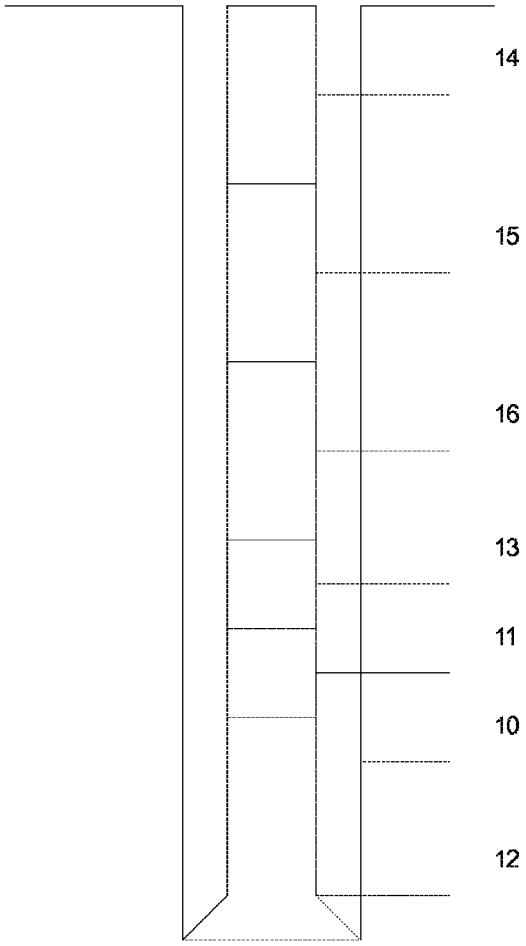
FIG. 1 is a side elevation view of the releasable connection apparatus in accordance with one example embodiment in a working configuration with associated drill bit, connector and coiled tubing.

Referring to FIG. 1, coiled tubing 14 is placed within a geotechnical stratum that operators wish to drill. At the lower end of the coiled tubing 14, a connector 15 connects the coiled tubing 14 to a releasable connection apparatus 16. Located below the releasable connection apparatus 16 is a sensor package 13.

A wellbore 10 is illustrated being drilled by a drill bit 12 being rotated by a downhole drilling motor 11. The motor 11 may be a positive displacement arrangement, in a non-limiting embodiment. In the illustrated embodiment, a lobed rotor and lobed stator arrangement may be used. In the illustrated embodiment, a drive shaft (not shown) is used to connect the drill bit 12 to the lobed rotor. Tools may be run along the length of the coiled tubing. In one non-limiting embodiment, the coiled tubing 14 is fed to an injector, wherein the injector drives the coiled tubing 14 into the well under pressure through a blowout preventer and stripper.

A sensor package 13 may be located at several positions on the coiled tubing for measurement of formation features, such as pressure and temperature as non-limiting embodiments. The sensor package 13 may be used to interface with a computer control to allow for autonomous control of the releasable connection apparatus 16. The sensor package 13 may be connected to the surface through a wireline connection, in a non-limiting embodiment, so that data may be supplied to operators during operations.

A releasable connection apparatus 16 is located to allow operators to release coiled tubing 14 located above the releasable connection apparatus 16 when necessary. Such conditions necessitating actuation of the releasable connection apparatus 16 may be when the coiled tubing 14 is stuck in an underground formation. In the illustrated embodiment, the releasable connection apparatus 16 is a generally cylindrical shape for ease of placement downhole.

The releasable connection apparatus 16 is provided with a structural weakpoint arrangement that is configured to fail at predefined tensile values exerted upon the releasable connection apparatus 16. The releasable connection apparatus 16, in the illustrated embodiment, is constructed with a "necked" or reduced structural material cross-section so that failure occurs at this cross-section rather than at other points in the releasable connection apparatus 16 or other points of the coiled tubing 14. In another embodiment, the reduced structural material cross-section may be replaced with a material that would fail at a predefined tensile force without the need for reducing the material cross-section. In either configuration, the structural weakpoint arrangement is connected to the lower portion of the mandrel through a threaded connection.

If, downhole, the coiled tubing 14 becomes stuck, a tensile load may be placed on the coiled tubing 14 to dislodge the coiled tubing 14 by the operators pulling up on the entire stuck apparatus. This tensile load may be up to 10,000 pounds of force. After actuation of the releasable connection apparatus 16, tensile loads of up to 50,000 pounds may be placed upon the coiled tubing 14. If, after exceeding 50,000 pounds, efforts are unsuccessful to dislodge the coiled tubing 14 from the formation, the releasable connection apparatus 16 may be actuated such that a disconnect may be made at the releasable connection apparatus 16.

Actuation of the releasable connection apparatus 16 may occur over successive tries, namely an operator may try to remove the coiled tubing 14 from the downhole environment by placing a tension on the coiled tubing 14. If the coiled tubing 14 does not move, the weakpoint in the apparatus 16 may be actuated. After the weakpoint has been compromised, successive tension pulls on the releasable connection apparatus 16 allows the successively greater tension pulls to be exerted on the coiled tubing 14. To signal to the operators that the releasable connection apparatus 16 has been actuated, an apparatus, described later, may be used to increase a sensed pressure value within the coiled tubing 14, therefore notifying operators of an actuated condition.

Unlike conventional apparatus that release pressure when a releasable connection apparatus 16 is actuated, aspects of the current embodiments notify operators by increasing overall pressure within the system, thus sending a clear signal that the weakpoint has been compromised.

FIG. 2 is a side elevation view of the releasable connection apparatus in accordance with the embodiment illustrated in FIG. 1. As can be seen in this embodiment, the releasable connection apparatus includes a plug 30 that can be positioned to impede or permit fluid flow through an opening 32. The plug 30 is operatively coupled to mandrel 35, which can be actuated from between first and second positions in this embodiment. The movement of the mandrel in response to actuation results in the plug moving between first and second corresponding positions, as will be described further below. To create the increase in pressure for the system, fluid flow normally passes through the interior volume of the coiled tubing 14 at a specified pressure. During actuation conditions, described below, fluid flow is restricted, thereby causing a spike in pressure for the fluid flow.

Referring to FIGS. 3 and 4, a running condition and actuated condition for a plug 30, as shown in FIG. 2, is illustrated in greater detail. The running condition allows fluid flow through the opening 32 at the base of the plug 30. Upon actuation of the plug 30, the plug retracts and fluid flow through the opening 32 is reduced, as best shown in FIG. 4. In one embodiment, the plug 30 may be at least partially conical in shape (which can be beneficial for erosion control) and/or may be configured to be removed from an outer body of the releasable connection apparatus 16. As can be appreciated, the plug 30 may be interchangeable, with different plug shapes being available to provide different desired flow rates and fluid densities.

Actuation of the plug 30 may be accomplished through direct mechanical connection after the weakpoint is compromised. In one embodiment, the plug 30 may be connected to a solenoid in an embodiment that allows for actuation of the plug from a first position (e.g., running condition) to a second position (e.g., actuated condition). In such an embodiment, the releasable connection apparatus 16 may include an arrangement that is configured to detect actuation of the solenoid. In a further embodiment, plug 30 may be actuated by a computer-based control system (e.g., having one or more microprocessors that execute suitably configured encoded instructions) in accordance with one or more set(s) of predefined conditions.

After ultimate release of the releasable connection apparatus 16, a fishing apparatus (not shown) may be lowered into the wellbore and connected to the stuck components in the wellbore. Such connections to the stuck components can be implemented such that sufficient tensile loading can be imparted to the stuck components to remove them from the wellbore.

Figure 5A:
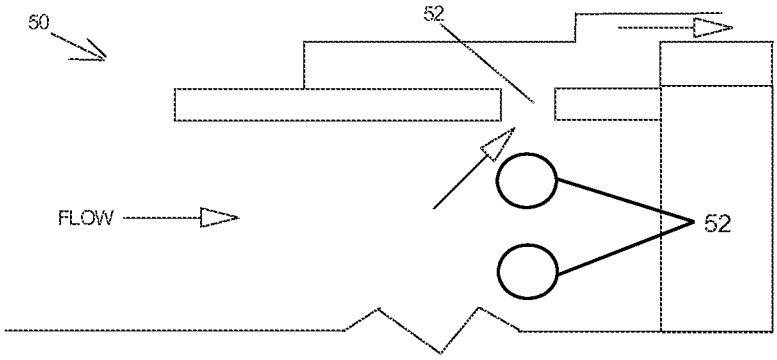
FIG. 5A is a side elevation view of a positive pressure circulation port of the releasable connection apparatus in a running condition.
Figure 5B:
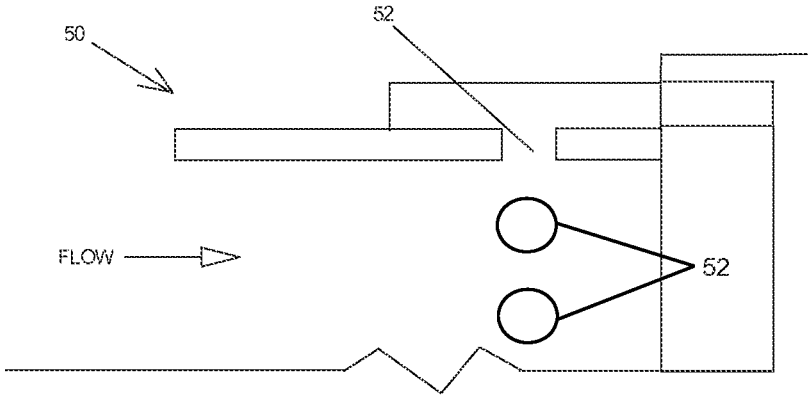
FIG. 5B is a side elevation view of a positive pressure circulation port of the releasable connection apparatus in an actuated condition.

To notify the operators of the status of the releasable connection apparatus 16, arrangements are described that will increase pressure within the system to notify operators of actuation. Referring to FIG. 5A, a positive pressure circulation port 50 is provided wherein one or more hole(s) 52 for providing the positive pressure circulation port are presented. In this illustrated embodiment, also known as the running condition, fluid flow is permitted from within the tool through the hole illustrated. In FIGS. 5A and 5B, the hole(s) 52 can be arranged such that they are non-staggered, i.e., at the same axial position with respect to the tool axis (e.g., the axis of the various interconnected components 11, 13, 14, 15, 16 (as shown in FIG. 1) forming the overall tool.

Referring to FIG. 5B, the actuated condition is illustrated wherein fluid flow is minimized from the open free space out the hole(s) of the positive pressure circulation port 50. The difference between the configuration in FIG. 5A and FIG. 5B is that in FIG. 5A, the fluid pressure is reduced because of the openings compared to that in FIG. 5B. The overall pressure can be checked inside the tool and, therefore, the state of the releasable connection apparatus 16 may be determined. If the pressure is in a "high" state, the configuration in FIG. 5B is present. If the pressure is in a lower state, the configuration in FIG. 5A is present.

Figure 6A:
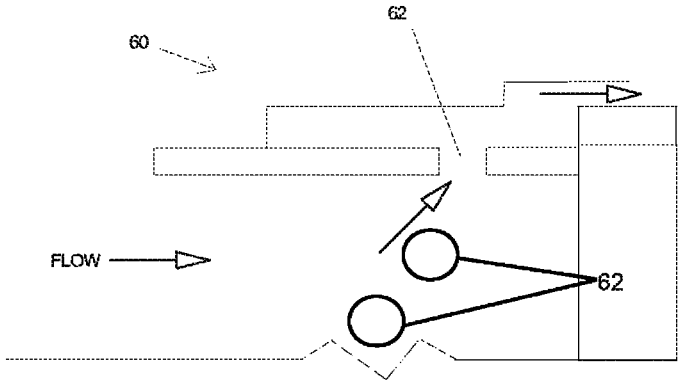
FIG. 6A is a side elevation view of a set of staggered holes of a positive pressure circulation port for stepped pressure increase when the releasable connection apparatus cycles is in a running condition.
Figure 6B:
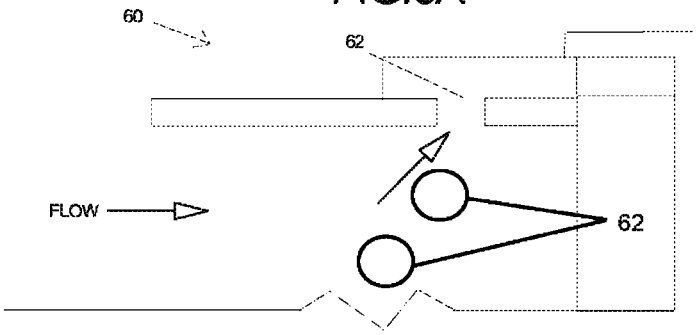
FIG. 6B is a side elevation view of a set of staggered holes of a positive pressure circulation port for stepped pressure increase when the releasable connection apparatus cycles in an actuated condition.

Similar to that described above, to notify the operators of the status of the releasable connection apparatus 16, arrangements are described that will increase pressure within the system to notify operators of actuation. Referring to FIG. 6A, a positive pressure circulation port 60 is provided wherein the holes 62 for providing the positive pressure circulation port are staggered as compared to those provided in FIGS. 5A and 5B. That is, the hole(s) 62 may be arranged at different axial positions with respect to the tool axis. In this illustrated embodiment of FIG. 6A, also known as the running condition, fluid flow is permitted from within the tool through the staggered hole(s) provided. Referring to FIG. 6B, the actuated condition is illustrated wherein fluid flow is minimized from the open free space out the staggered hole(s) of the positive pressure circulation port.

Figure 7A:
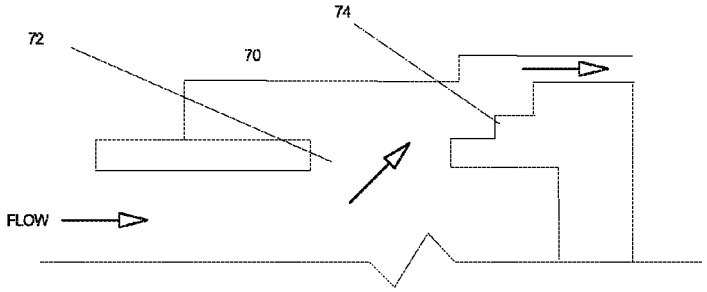
FIG. 7A is a side elevation view of a stepped restrictor for stepped pressure increase as the releasable connection apparatus cycles in a running condition.
Figure 7B:
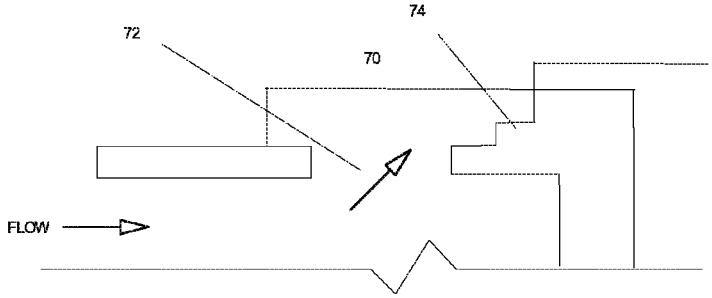
FIG. 7B is a side elevation view of a stepped restrictor for stepped pressure increase as the releasable connection apparatus cycles in an actuated condition.

Referring to FIG. 7A, a stepped restrictor plate 70 for step pressure increase is presented in accordance with another embodiment. In this illustrated embodiment, the running condition allows fluid flow materials to openly exit through an entrance 72 provided. In the actuated condition in FIG. 7B, fluid flow is prevented as no clear or open passages are available through the steps 74 of the restrictor plate 70, thus increasing pressure. As will be apparent to a person of skill in the art, steps 74 may be provided axially or circumferentially, on the plate 70 or corresponding mating surfaces, as necessary. As the tool cycles, fluid flow may be eliminated or minimized based upon the amount of open area presented for fluid flow. During tool cycling, the overall configuration presented for open fluid flow is modified according to the positions of the relative components. Thus, at different times, different flow areas are presented for fluid flow. Although illustrated in the present embodiment as having three steps 74 for the stepped restrictor plate 70, a person of skill in the art will understand that differing numbers of steps may be used.

Figure 8A:
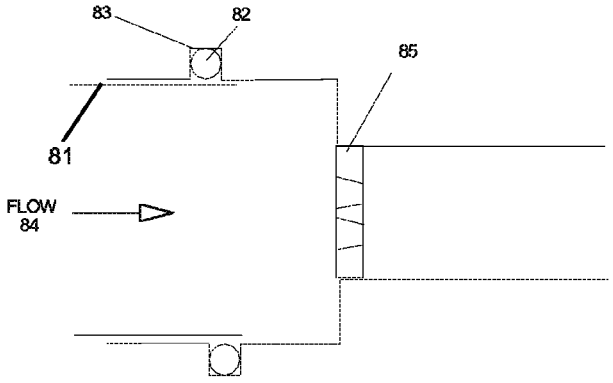
FIG. 8A is a captured ball drop arrangement that is configured to increase pressure as the tool cycles, wherein the ball is in a running condition.
Figure 8B:
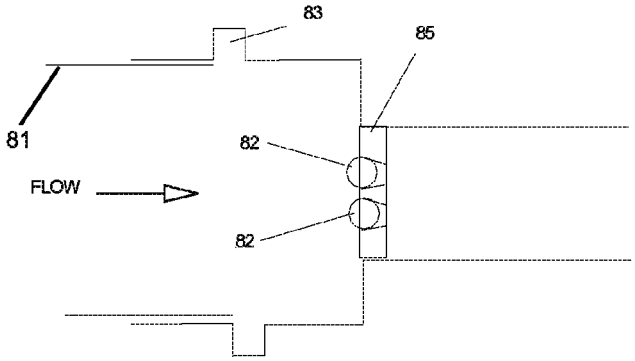
FIG. 8B is a captured ball drop arrangement that is configured to increase pressure as the tool cycles, wherein the ball is in an actuated condition.

Referring to FIG. 8A, a captured ball drop arrangement 80 is illustrated. In the illustrated embodiment, a ball 82 is kept in a retainer 83 out of the flow path 84 of fluid within the tool by way of mandrel 81. Upon actuation, as illustrated in FIG. 8B, the ball 82 is dislodged from the retainer 83 and enters the fluid flow stream. The ball 82 then impinges upon a retainer plate 85 that is arranged to capture the ball 82. In the captured position, fluid flow is minimized as the ball 82 restricts fluid passing through the retainer plate 85. As a person of skill in the art will recognize, numerous balls 82 may be used as well as numerous holes in the retainer plate 85 as a non-limiting embodiment. Materials that can be used to fabricate the ball 82 include metallic materials to prevent erosion and corrosion from occurring during fluid flow activities. Such materials may be aluminum or stainless steel, as non-limiting embodiments. The retainer plate 85, as illustrated in both of the figures, may have a cone shaped configuration to allow capturing of the ball 82 in a secure manner.

Figure 9A:
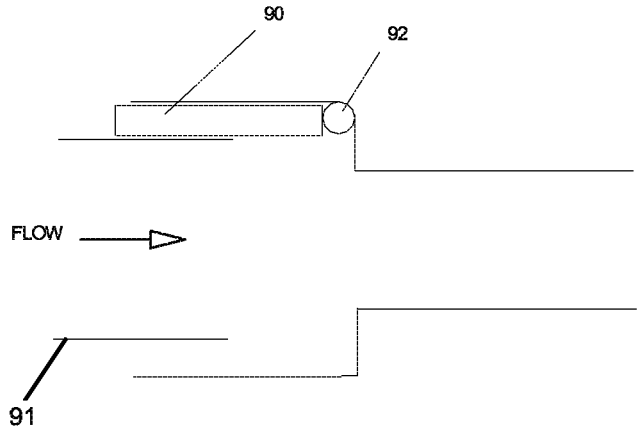
FIG. 9A is a flapper valve arrangement that is configured in a retracted position as contained by the mandrel of the releasable connection apparatus, the flapper valve arrangement in a running condition.

Referring to FIG. 9A, a flapper valve arrangement 90 is illustrated. The flapper valve arrangement 90 is held in the "running" condition by the mandrel 91 which has a position that impedes the flapper valve arrangement 90 from closing into the fluid flow path. In the illustrated embodiment, the length of the flapper valve arrangement 90 is designed, to extend across the open area adjacent to the flapper valve arrangement 90. Although not viewable, the flapper valve arrangement 90 is configured with a hinge 92 that moves the flapper valve arrangement 90 to an actuated condition, as provided in FIG. 9B. The hinge 92 may be a spring hinge or any other arrangement that permits closure of the flapper valve arrangement 90.

Figure 9B:
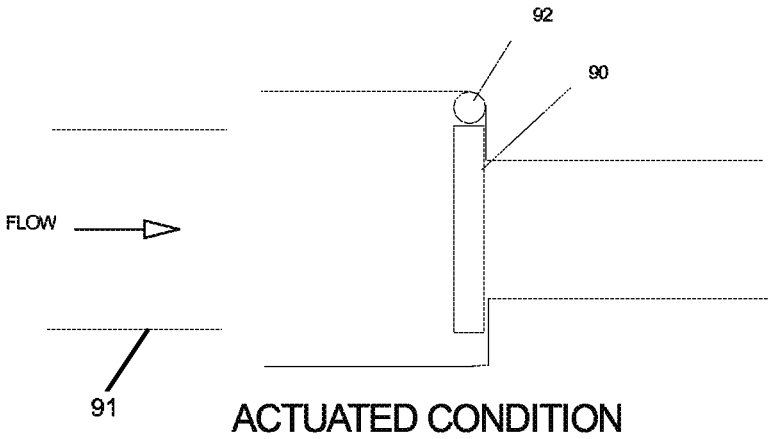
FIG. 9B is a flapper valve arrangement that is configured in an extended position for the releasable connection apparatus, the flapper valve arrangement in an actuated condition.

Referring to FIG. 9B, the flapper valve arrangement 90 is illustrated in the actuated condition. The actuated condition extends across the open area 92 as illustrated. Again, as in the other configurations, the actuated condition represents a higher pressure condition than the running condition.

The flapper valve arrangement 90 may be made of any material that would provide for minimization of erosion during flow conditions experienced through the flapper valve arrangement 90. These materials may include aluminum and stainless steel as non-limiting embodiments.

Figure 10A:
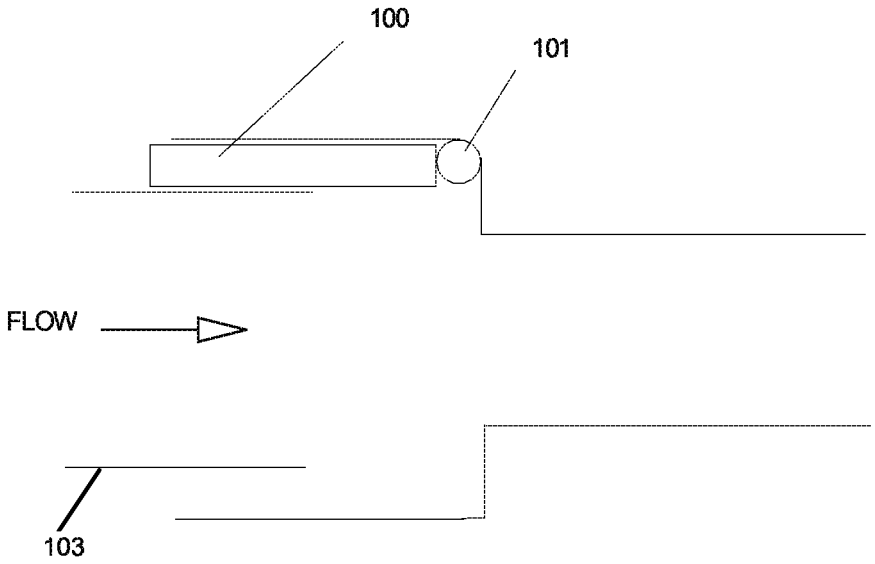
FIG. 10A is a slotted flapper valve arrangement that is configured in a retracted position as contained by the mandrel of the releasable connection apparatus, the flapper valve arrangement in a running condition.

Referring to FIG. 10A, a slotted flapper valve arrangement 100 is illustrated. The slotted flapper valve 100 is held in the running condition by the mandrel 103 which impedes the flapper valve arrangement 100 from closing into the fluid flow path. The length of the slotted flapper valve 100 is designed, in the illustrated embodiment, to reach across the open area of the inside area adjacent to the flapper valve 100. Although not viewable, the slotted flapper valve arrangement 100 is configured with a spring hinge that moves the slotted flapper valve arrangement 100 to an actuated condition, as provide in FIG. 10B.

Figure 10B:
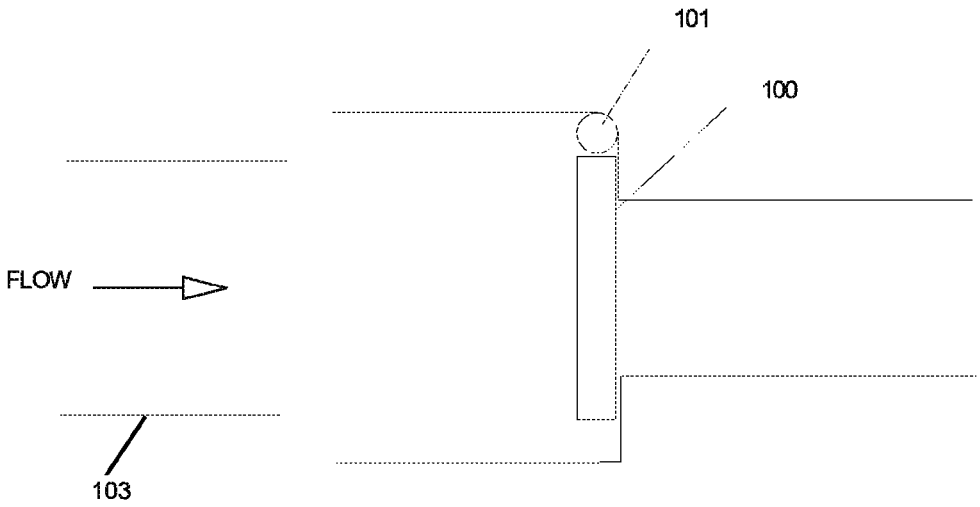
FIG. 10B is a slotted flapper valve arrangement that is configured in an extended position as contained by the mandrel of the releasable connection apparatus, the flapper valve arrangement in an actuated condition.
Figure 10C:
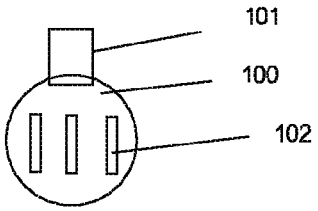
FIG. 10C is an end view of the slotted flapper valve arrangement of FIGS. 10A and 10B.

Referring to FIGS. 10B and 100, the slotted flapper valve arrangement 100 is illustrated in the actuated condition. The actuated condition extends across the open area as illustrated. The slotted flapper valve arrangement 100 may be configured with any number of slots to either completely cut off flow or to allow a defined amount of flow through the slotted flapper valve arrangement 100 according to flow conditions experienced by the flapper valve arrangement 100. Slots 102 are provided in the arrangement 100 to provide an opening. The flapper valve arrangement 100 is permitted to actuate through a hinge 101.

The slotted flapper valve arrangement 100 of FIG. 10A may be made of any suitable material that would provide for minimization of erosion during flow conditions experienced through the slotted flapper valve arrangement 100. These materials may include aluminum and stainless steel as non-limiting embodiments. Although described as "slotted", a person of skill in the art will understand that other opening types may be provided in the flapper valve arrangement 100 of FIGS. 10A and 10B. Such configurations include rounded holes, as a non-limiting embodiment.

Figure 11A:
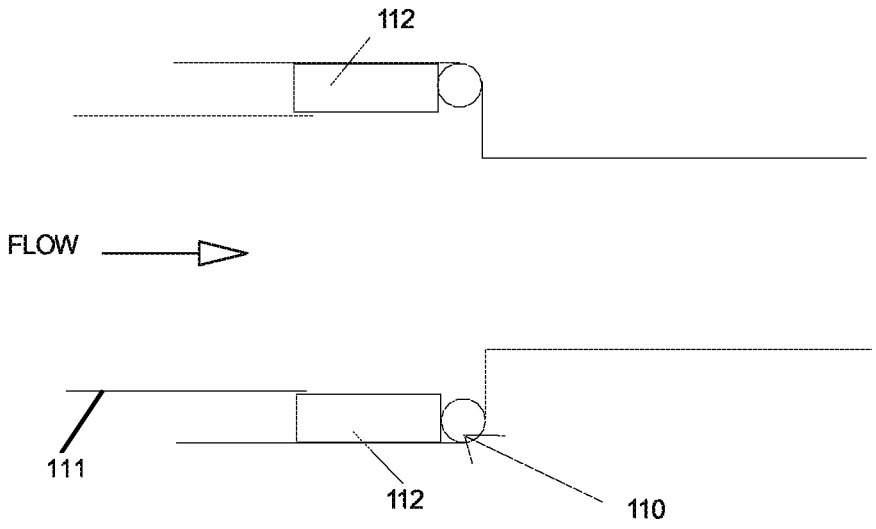
FIG. 11A is a split flapper valve arrangement that is configured in a retracted position as contained by the mandrel of the releasable connection apparatus, the flapper valve arrangement in a running condition.

Referring to FIG. 11A, a running condition of a split flapper valve arrangement 110 is illustrated. In the illustrated embodiment, the split flapper valve arrangement 110 is positioned on opposite sides of the open pathway in the tool, each being held in the running condition by mandrel 111. The split flapper valve arrangement 110 is configured such that either of the individual flaps 112 may be actuated (into a position impeding fluid flow), or both of the individual flaps 112 may be actuated to impede fluid flow, thus increasing pressure. The corresponding split flapper valve arrangement 112 may be of equal overall length or one flap 112 may be longer in length than the corresponding alternative flap. The flaps 112 themselves may be hinged at their most outward edges to allow for free range spin to the actuated position. The flaps 112 may be configured with stops to prevent actuation than a furthermost point. In the illustrated embodiment, the furthermost point allows the respective flaps to extend perpendicular to the flow.

The flaps 112 provided in FIG. 11A are made of a durable material to allow for superior service life. Example materials that the flaps 112 may be constructed from are non-corrosive metals. As provided in other example embodiments, the flaps 112 may be constructed with slots. The size of the slots configured in the flaps 112 may be provided such that a predetermined area of open flow is permitted, if desired.

Figure 11B:
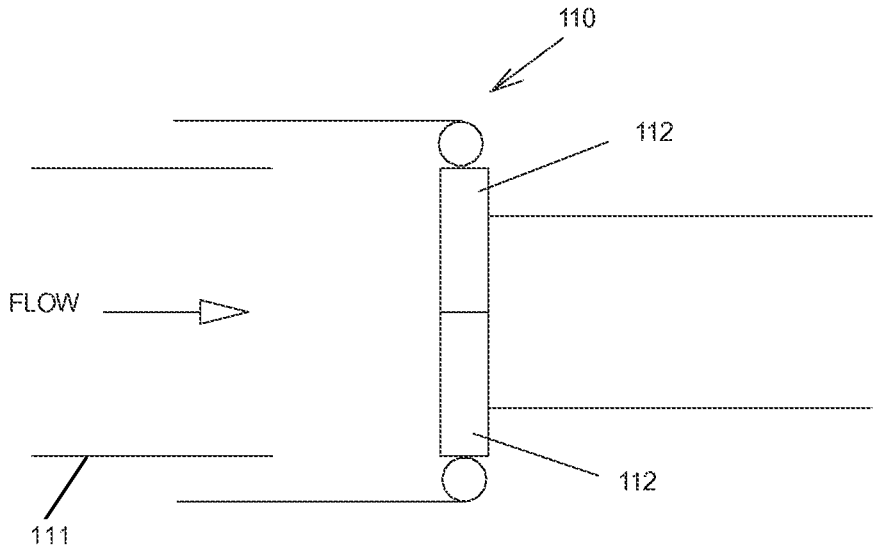
FIG. 11B is a split flapper valve arrangement that is configured in an extended position of the releasable connection apparatus, the flapper valve arrangement in an actuated condition.

Referring to FIG. 11B, an actuated condition for the split flapper valve arrangement 110 of FIG. 11A is illustrated. In the actuated condition, no flow is permitted through the split flapper valve arrangement 110, thus increasing pressure. In the embodiments described in FIGS. 9A-11B, the spring hinge may include a Belleville, helical, or ring spring. In one embodiment, the spring may be integrally machined into the weakpoint of the releasable connection apparatus. In the embodiments set forth in FIGS. 8A-11B, the mandrel (e.g., 81, 91, 103, 111) may be actuated by a solenoid.

To summarize, the various embodiments described above provide for changing the flow area of a multi-stage disconnect after a first stage has been actuated. For instance, the multi-stage disconnect cycle may be of a type disclosed in commonly assigned U.S. Pat. No. 5,857,710, which is hereby incorporated by reference in its entirety. Release of the releasable connection apparatus by way of such a disconnect cycle can be initiated, for example, by a tensile pull. The flow area can be varied in response to stroke or electronic control (e.g., a solenoid valve). In some embodiments, the first stage actuation can be sensed electronically. In some embodiments, the downhole tool operates autonomously (with no control from the surface). The flow restriction can cause an increase or decrease in pressure when activated. In one embodiment, the flow restriction can be activated prior to release/disconnect. In another embodiment, the flow restriction is coupled to relative telescopic displacement. As mentioned above, the weakpoint may be spring loaded in certain embodiments, which can prevent loss of preload.

As will be understood, the various techniques described above and relating to a releasable connector for a coiled tubing drilling assembly are provided herein by way of example only. Accordingly, it should be understood that the present disclosure should not be construed as being limited to only the examples provided above.

The foregoing outlines feature of several embodiments so that those skilled in the art may better understand the aspects of the disclosure. Those skilled in the art should appreciate that they may readily use the present disclosure as a basis for designing or modifying other processes and structure for carrying out the sample purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A releasable connection apparatus for coiled tubing, comprising:

an outer body configured with an inner volume;

a mandrel located at least partially within the outer body and in the inner volume, the mandrel configured to be actuated by an operator from a first non-actuated position to a second actuated position;

a plug located within the outer body, the plug movable between a first position to a second position, the plug actuated by the mandrel, wherein when the plug is in the first position, a clear flowpath is maintained for materials flowing past the mandrel and wherein when the plug is in the second position, the flowpath is at least partially blocked, wherein in the second position an increase in fluid pressure occurs signaling actuation of the releasable connection; and a structural weakpoint apparatus, wherein the structural weakpoint apparatus is configured to structurally fail at a predetermined tensile load placed upon the releasable connection apparatus, wherein the structural weakpoint apparatus is configured at a lower end of the mandrel.

2. The releasable connection apparatus according to claim 1, wherein the plug is cone shaped.

3. The releasable connection apparatus according to claim 1, wherein the plug is configured to be removed from the outer body.

4. The releasable connection apparatus according to claim 1, further comprising a solenoid connected to the plug, wherein the solenoid is configured to actuate the plug from the first position to the second position.

5. The releasable connection apparatus according to claim 4, further comprising an arrangement configured to detect when the solenoid valve is actuated.

6. The releasable connection apparatus according to claim 1, further comprising a computer control connected to the plug, wherein the computer control may actuate the plug according to a set of predefined conditions.

7. The releasable connection apparatus according to claim 1, wherein the structural weakpoint apparatus is spring preloaded to prevent loosening of the structural weakpoint apparatus.

8. A releasable connection apparatus, comprising:

an outer body configured with an inner volume;

a mandrel located at least partially within the outer body and in the inner volume, the mandrel configured to be actuated from a first non-actuated position to a second actuated position;

a solenoid connected to the mandrel, wherein the solenoid is configured to actuate the mandrel from the first non-actuated position to the second actuated position;

a restriction arrangement located within the outer body, the restriction arrangement movable between a first position to a second position, wherein when the restriction arrangement is in the first position, a clear flowpath is maintained for materials flowing within the outer body and wherein when the restriction arrangement is in the second position, the flowpath is at least partially blocked; and a structural weakpoint apparatus, wherein the structural weakpoint apparatus is configured to structurally fail at a predetermined tensile load placed upon the releasable connection apparatus.

9. The releasable connection apparatus according to claim 8, wherein the restriction arrangement is configured to be removed from the outer body.

10. The releasable connection apparatus according to claim 8, wherein the structural weakpoint apparatus is configured with a spring.

11. The releasable connection apparatus according to claim 10, wherein the spring comprises at least one of a Belleville spring, a helical spring, or a ring spring.

12. The releasable connection apparatus according to claim 8, wherein the restriction arrangement comprises at least one of a flapper arrangement, a plug, a slotted flapper valve, or a split flapper valve arrangement.

13. A method to indicate actuation of a coiled tubing releasable connection apparatus, comprising:

providing a coiled tubing arrangement in a downhole configuration, wherein the coiled tubing arrangement is provided with at least one coiled tubing releasable connection apparatus;

conducting a tensile pull on the coiled tubing arrangement, wherein the tensile pull initiates a release of the at least one coiled tubing releasable connection apparatus;

impeding a flow within the coiled tubing arrangement such that a pressure increase is created in the flow after initiation of the release of the at least one coiled tubing releasable connection apparatus; and sensing the pressure increase from the impeded flow.

14. The method of claim 13, wherein impeding the flow comprises actuating a restriction arrangement comprising at least one of a plug, a flapper valve arrangement, a stepped restrictor plate, or a slotted flapper valve arrangement.

15. The method of claim 13, wherein sensing the pressure increase is performed at the surface.

16. The method of claim 13, wherein the release of the at least one coiled tubing releasable connection apparatus is accomplished using a multi-stage disconnect cycle.

* * * * *